United States Patent [19]

McCall

[11] 4,090,608

[45] May 23, 1978

[54] MAILING CARTON WITH COVER FOR BOOKS

[76] Inventor: Richard J. McCall, 1515 N. Sedgwick St., Chicago, Ill. 60610

[21] Appl. No.: 791,069

[22] Filed: Apr. 26, 1977

[51] Int. Cl.[2] ..... B65D 5/36

[52] U.S. Cl. ..... 206/424; 229/40

[58] Field of Search ..... 206/424, 521; 229/40

[56] References Cited

U.S. PATENT DOCUMENTS

| | | | |
|---|---|---|---|
| 3,227,356 | 1/1966 | Eifrid | 229/40 X |
| 3,792,811 | 2/1974 | Carpenter et al. | 206/424 |

*Primary Examiner*—Stephen P. Garbe

*Attorney, Agent, or Firm*—Hill, Gross, Simpson, Van Santen, Steadman, Chiara & Simpson

[57] ABSTRACT

A mailing carton of the type having end air pockets is strengthened at each end by edges formed by multiple layers of corrugated material extending outwardly from the interior compartment, by reinforced layers of corrugated material forming an end wall inwardly from the reinforced edges, and by top and end covers. The top and end covers facilitate utilization of an "L" shaped sealing tool for sealing the end walls of the top panel by short reinforced adhesive tape segments disposed on surfaces in right angular relationship.

6 Claims, 8 Drawing Figures

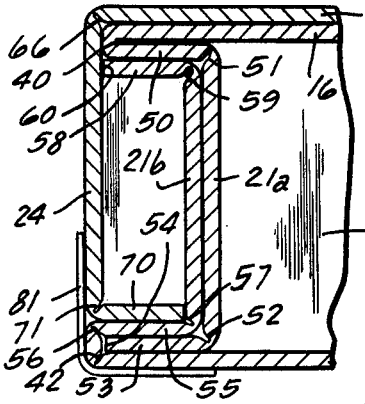
Fig. 5
Fig. 6
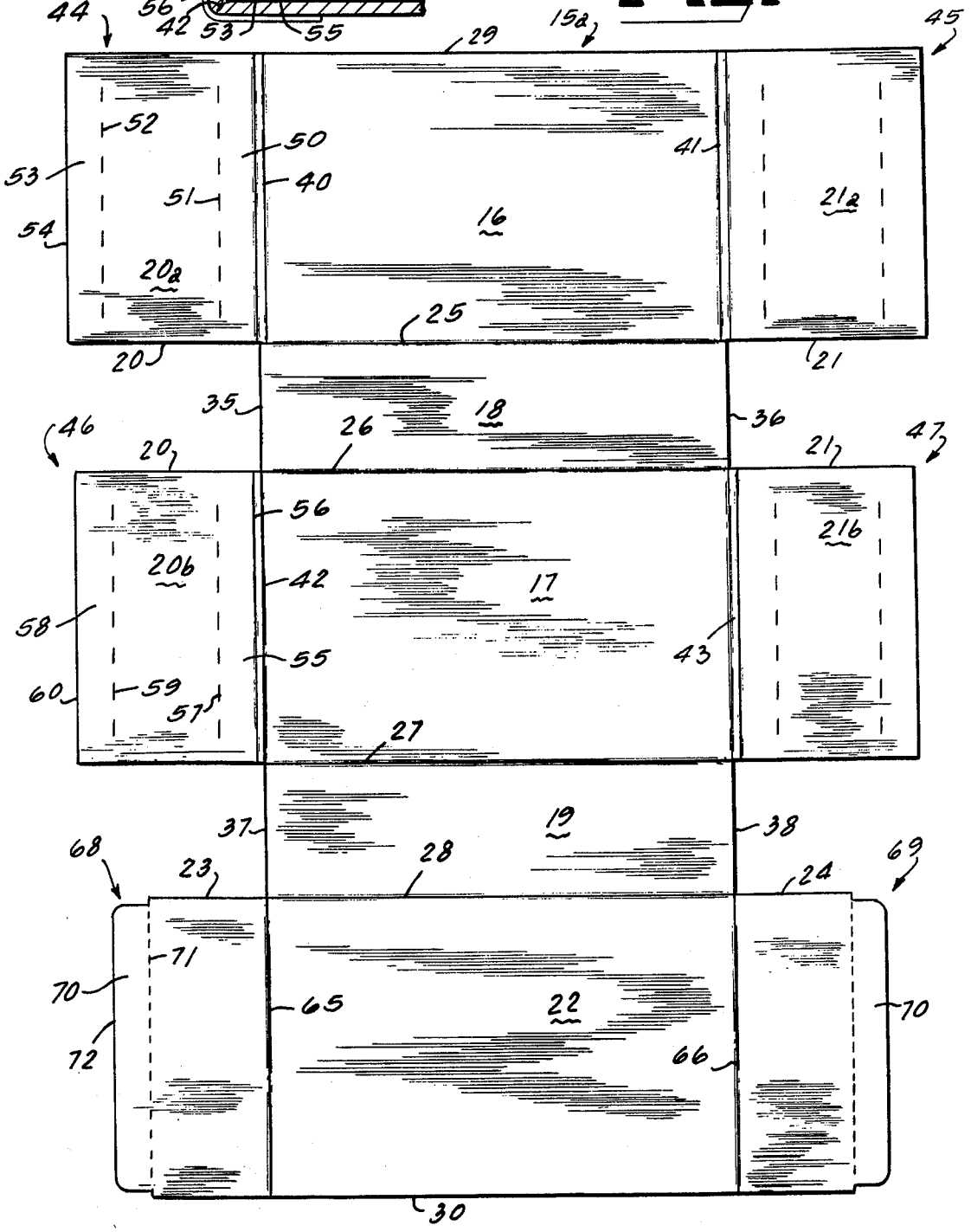

MAILING CARTON WITH COVER FOR BOOKS

BACKGROUND OF THE INVENTION

1. Field of the Invention

The present invention relates to a mailing carton formed from a one-piece blank which is cut and scored for folding and sealing to transport one or more articles such as books.

2. The Prior Art

Protection of books and other relatively heavy but compact articles for handling through mailing systems requires that end edges of the mailing containers therefor be reinforced to absorb shocks. My prior U.S. Pat. Nos. 3,426,957, 3,712,531, and 4,006,822, exemplify the state of the art in utilizing various means for increasing the strengths of end edges of relatively shallow mailing cartons by providing air pockets or recesses and angulated members at the ends. Construction of deeper cartons for mailing thicker or greater numbers of books has required very heavy sheet materials to provide desired rigidity, with wrappings of tape to ensure security of the parcel. My co-pending application, filed Apr. 14, 1977 as Ser. No. 787,484, discloses a mailing carton having end edge recesses for sealing the carton between the top and end walls.

SUMMARY OF THE INVENTION

In accordance with the invention, a heavy duty mailer is provided with augmented multiple layers of material at critical stress points to provide a quadruple layered air pocket buffer, a double layered end wall, and end wall and top covers, all provided from a one-piece blank. An "L" shaped sealing tool can apply segments of reinforced pressure sensitive adhesive tape directly to the end wall covers and the bottom panel disposed in right angle relationships to one another. The carton handles with protective safety as many as six books, or an equivalent weight of fewer but larger books, as thick as 2¾ inches (70 mm) or more.

THE DRAWINGS

FIG. 5 is a side sectional view through an end of the carton of FIG. 1, taken on line V—V thereof.

FIG. 6 is a plan view of a sheet-form blank cut and scored for assembling the mailing carton with cover of the present invention.

THE PREFERRED EMBODIMENTS

Figure 1:
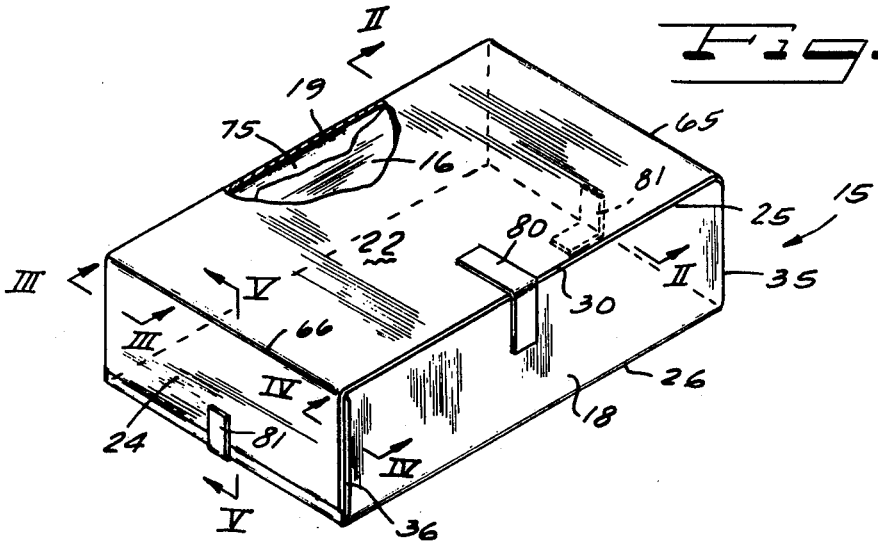
FIG. 1 is a general perspective view, partly cut away, of a mailing carton of the present invention.
Figure 2:
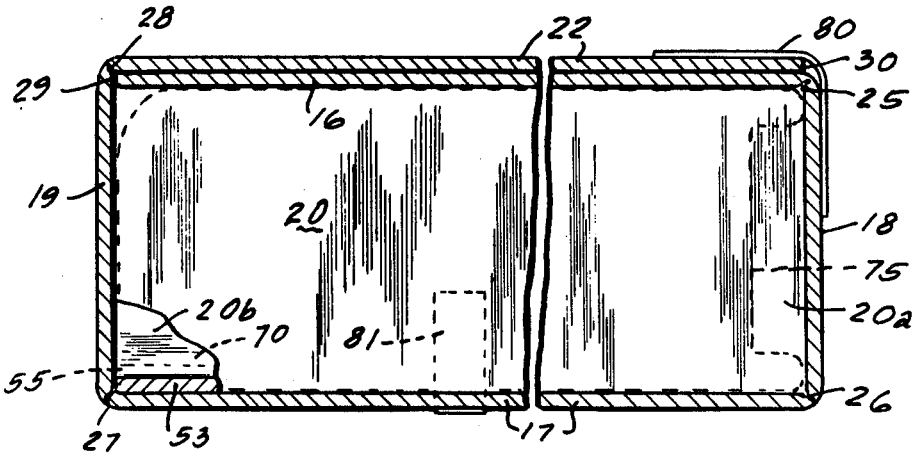
FIG. 2 is an edwise sectional view through the container, taken on line II—II of FIG. 1.
Figure 3:
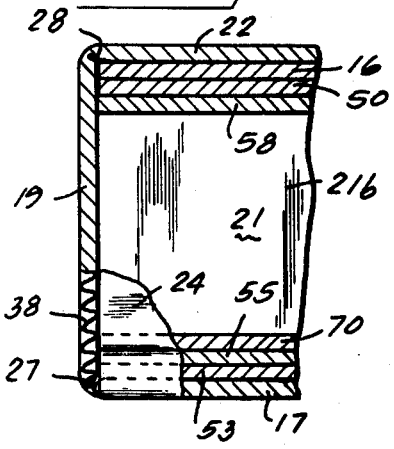
FIG. 3 is an edwise elevational view partly in section, of an end of the carton, on line III—III of FIG. 2.
Figure 4:
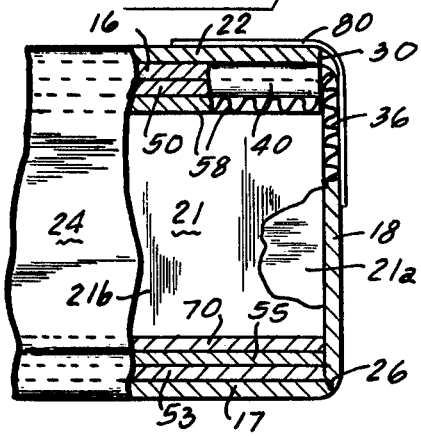
FIG. 4 is an endwise elevational view, partly in section, of an end of the mailing carton, taken on line IV—IV of FIG. 1.

A mailing carton 15 constructed in accordance with the principles of the present invention as shown in FIG. 1 is completely assembled form. The mailing carton 15 is constructed of a corrugated sheet stock material which is cut, scored, and folded from a one-piece blank more completely shown in FIG. 6 into the exterior configuration shown for mailing one or more articles such as a book 75 within a generally rectangular space formed within the carton.

Referring to FIG. 6 in conjunction with the other figures, the carton 15 comprises a top panel 16 and a bottom panel 17 which are both of the same size and shape and which are maintained in spaced parallel relation with one another. First and second side walls 18, 19 and opposing end flaps 20, 21 complete a space enclosure as shown. A cover panel 22 is connected to the second side wall 19 along an edge thereof for overlying engagement with an upper surface of the top panel 16. The cover 22 has opposing end cover flaps 23, 24 attached to either end thereof.

Since the carton 15 is formed from a single piece of sheet form material, all the panels, walls, and flaps, are connected together along fold lines forming edges thereof. The top panel 16 is connected to the first side panel along a first fold line 25, the first side panel 18 is connected to the bottom panel 17 by a second fold line 26 which is parallel to the fold line 25, and the bottom panel 17 is connected to the second side panel 19 by a third fold line 27. The cover panel 22 is connected to the second side panel 19 by a further, fourth fold line 28. The top panel 16 has a free edge 29, and the cover 22 has an opposite free edge 30. Edges 35, 36, 37, and 38 of the side panels 18 and 19 transverse to the fold lines 25, 26, 27 and 28, are also free.

Each of the top and bottom panels 16, 17 has respective opposite end edges and end fold lines 40, 41 and 42, 43 transverse to the primary fold lines 25–28 and the free edges 29, 30. End flaps 44, 45, 46, 47 are foldably attached to the end edges 40–43. They are formed and folded in accordance with the invention to provide the double-thickness end walls 20, 21 as well as double-thickness reinforcement of the end edges of the panels 16, 17. Each of the end flaps 44 and 45 are identical or mirror images of one another about the top panel 16, as are the end flaps 46, 47 attached to the bottom panel 17. The flaps 44, 45 form inner end flaps and inner reinforcement members, while the end flaps 46, 47 form outer end flaps and outer reinforcement members.

The end flap 44 is comprised of a first, inner reinforcement member 50 connected to the top panel 16 at end fold line 40, with the fold line 40 adapted to orient the member 50 into a face to face abutting relationship to the lower surface of the top panel 16, as for instance in FIG. 5. The first inner reinforcement member 50 is connected to an inner one **20*a* of the end flaps 20 by a parallel fold line 51. Opposite the reinforcement member 50, and connected to the inner end flap 20*a* by a further parallel fold line 52 is a second inner reinforcement member 53. An end edge 54 of the second reinforcement member 63** is free.

The end flaps 46, 47 connected to the bottom panel 17 are constructed similarly to the end flaps 44, 45, each comprising a first outer reinforcement member 55 connected directly to the bottom panel 17 by double fold lines 42, 56. The fold lines 42, 56 are spaced apart by a distance sufficient to accept therebetween the thickness of the second inner reinforcement member 53, as shown in FIG. 5. A second fold line 57 connects the first outer reinforcement member 55 to an outer one **20*b* of the end flap 20. A second, outer reinforcement member 58 is connected to an upper edge of the outer end flap 20*b* along a fold line 59. An outermost edge 60 of the end flap 46 and of the second, outer reinforcement member 58**, is free in the finished carton.

In accordance with the principles of the present invention, the top cover panel 22 is attached to the second side panel 19 at fold line 28 as noted above. The fold line 28 adapts the cover 22 to overlie in parallel adjacency the top panel 16. The top cover 22 has opposite end edges 65, 66 comprising fold lines for joining end cover flaps 68, 69 thereto. Each of the end cover flaps 68, 69 comprises the end cover panel 23, 24 joined to the top cover at the fold lines 65, 66, and a cover panel bracing member 70 on the outer end thereof joined to the end cover panel along a fold line 71. As shown in FIG. 5, each end cover panel 23, 24 has a length between fold lines 66 and 71 substantially equal to the length of the inner end flaps 20*a*, 21*a*, to place the bracing member immediately upwardly adjacent the outer reinforcing members 55. The end cover panel also has a width in the direction of the fold line 65 substantially equal to the width in the direction of the cover panel 22. The cover bracing member 70, however, is slightly reduced in width outwardly of the fold line 71 to facilitate assembly of the mailing carton. The cover bracing member 70 is adapted to overlie the first outer reinforcing member 55 of the outer end flap 46 and to abut a free edge 72 against the outer end flap 20*b* in the assembled condition.

Further in accordance with the principles of the invention, the panels, walls, and flaps of the carton 15 are quickly secured at the point of assembly by application of three short segments of tape 80; 81, 81. One segment is applied between the top cover 22 and first side wall 18 and between each of the end cover panels 23, 24 and the bottom panel 17. The end cover tapes each pass over a short portion of the outer reinforcing member as in FIG. 5. The tape segments 80, 81 comprise a high tensile strength binding tape which may have fiber reinforcements running lengthwise thereof. The tape segments 80, 81 are conveniently applied by an automatic machine commercially adapted for applying tape to such right-angle surfaces.

In use, the mailing carton 15 is assembled from a sheet form blank 15*a* of FIG. 6 which has been cut and scored to a desired shape and size for panels 16, 17, 18, 19, 20, 21, 22, 23, and 24. Normally blanks as shown in FIG. 6 will be provided to a customer in flat form to conserve shipping and storage space and costs.

Figure 7:
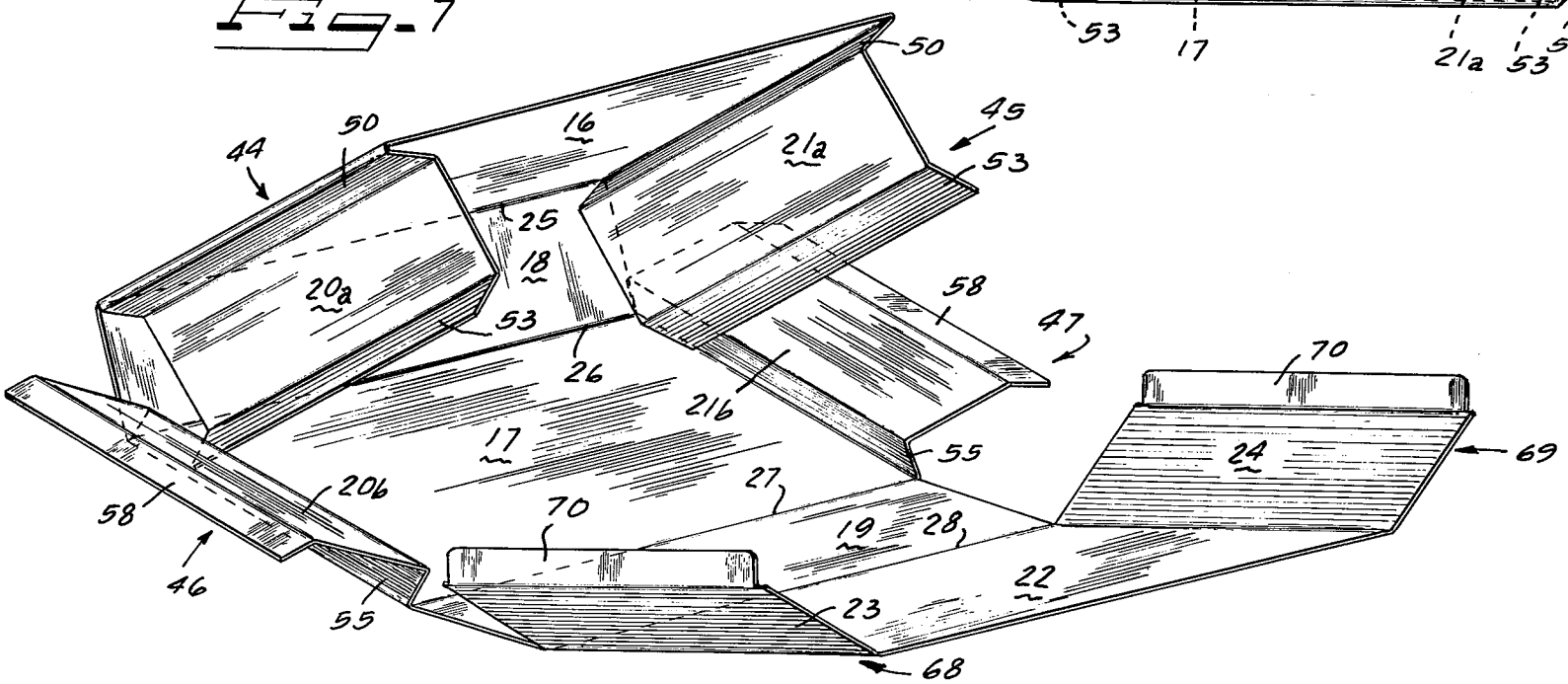
FIG. 7 is a perspective view of the blank of FIG. 6 during an early assembly stage thereof.

Once a blank 15*a* is needed for assembly, the first side panel 18 and the top panel 16 are folded respectively on lines 26 and 25 from the bottom panel 17. As shown in FIG. 7, the end panels 44–47 may also be folded upwardly and inwardly, with the first inner reinforcement members 50 folded flat against the undersurface of the top panel 16 and the second inner reinforcing member 53 extending between the bottom panel 17 and the first outer reinforcement member 55 of the end flap 46.

Figure 8:
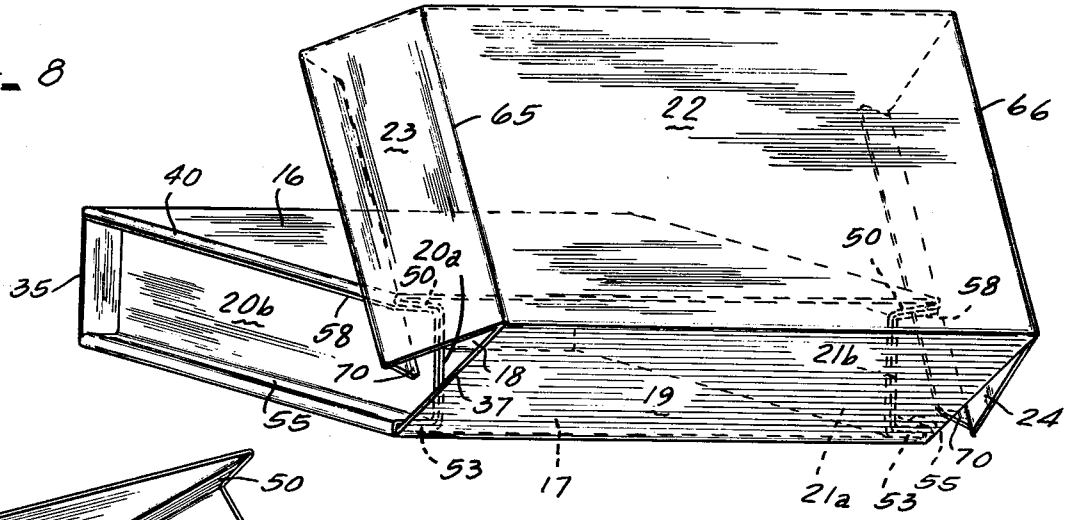
FIG. 8 is a further perspective view of the blank of FIGS. 6 and 7, before final placement of the top and end covers.

Once the top and bottom panels 16 and 17 have been placed in parallel relationship to one another, with the outer end flaps 46 forced into the end recesses and with the second outer reinforcing member 58 against the first inner reinforcing member 50, in the manner of FIG. 8, the carton 15 will substantially hold its own shape. The carton 15 is then loaded with one or more books 75.

As a final operation, the cover 22 is laid over the top surface of the top panel 16. The end cover flaps 68, 69 are folded downward along the respective fold lines 65, 66 and the cover brace members 70 are inserted between the first and second side walls 18, 19 with the end cover panels 23, 24 in parallel spaced relation to the end flaps 20, 21 inwardly of the edges of the top and bottom panels. The top cover is affixed to the first side edge 18 by a first strip of adhesive tape 80, applied by the L-shaped tape dispenser, while the end cover panels 23, 24 are attached to the bottom panel 17 by the machine, by applying the tape segments 81, 81 therebetween and over the exposed portion of the outer end flaps 46, 47.

The carton 15 thus formed has four layers of corrugated material protecting each top and bottom end edge of the space within the carton, helping to insure that the contents of the carton will not be damaged upon rough handling during shipment. The enclosed air cells at each end formed by the three layers of material rigidify the carton and further protect against damage.

Although various minor modifications may be apparent to those skilled in the art, it should be understood that I wish to embody within the scope of the patent warranted hereon all such modifications as reasonably and properly come within the scope of my contribution to the art.

I claim as my invention:

1. A mailing carton with cover comprising:

a one-piece blank of paperboard stock having spaced flat sides separated by corrugations to form inside, outside, and cover surfaces for the carton, said blank having a main top wall panel, a main bottom wall panel, and a top cover, a first side wall panel between the main top and bottom panels, and a second side wall panel between the main bottom panel and said top cover, each of said main panels having at each opposite end a 3-panelled end flap including a major centrally disposed end wall panel having a length transverse to said main panel ends and a pair of minor reinforcement members, one on either side of the end wall panel, said top cover having at each opposite end a two-panelled end cover flap including an end wall cover panel adjacent said top cover and a cover brace panel outwardly thereof, the end wall cover having a length transverse to said end of said top cover not exceeding substantially said length of a larger one of said end wall panels, so that the cover brace panel is placed into facially abutting relation to one of the minor reinforcement panels and into edgewise abutting relation to one of said end wall panels adjacent thereto, whereby in assembled form there are provided quadruple thickness end corners, double thickness end walls, and spaced end covers to protect the contents of the carton, said end covers accommodating an L-shaped sealer machine for application of a sealing tape to right angle surfaces at junctions of the bottom wall panel and the end covers.

2. A covered mailing carton formed of a sheet material, the carton comprising:

parallel top and bottom panels and a top cover each having side edges and end edges;

two parallel side walls extending between the top and bottom panels at and transversely to said side edges thereof;

inner and outer end flaps extending inwardly of and between adjacent edges of the top and bottom panels at each end thereof, each said end flap comprising:

two reinforcement portions and one end wall panel extending therebetween, said reinforcement portions extending parallel to the top and bottom panels and spacing said end wall therebetween inwardly of said end edges of said top and bottom panels, whereby a double-thickness end wall is provided, an inner one of the end wall panels having a length between the top and bottom panels, a pair of end covers each extending substantially between said top cover and an uppermost one of the reinforcement portions adjacent said bottom panel at said end edges thereof, each said end cover comprising:

an end cover panel foldably affixed to the top cover and having a length transverse to the end edge of the top cover not exceeding substantially the length of the inner end wall panel, and an end cover bracing member foldably affixed to the end cover panel and abutting said outer end flap upwardly adjacent said bottom panel, whereby to reinforce and to rigidify the end edges of the top and bottom panels of said carton and to form recessed and covered end walls therefor.

3. A covered mailing carton as defined in claim 2, wherein said end cover panels extend between end edges of said side walls, and each said bracing member abuts a lowermost portion of said outer end wall adjacent one of the reinforcing members.

4. A mailing carton formed from corrugated sheet stock and comprising:

a rectangular top panel having transverse side and end edges;

a rectangular bottom panel opposite said top panel and having corresponding side and end edges;

a rectangular top cover overlying said top panel and having corresponding side and end edges;

a rectangular first side panel joining the top and bottom panels by folds formed along two side edges thereof;

a rectangular second side panel joined to the bottom panel opposite the first side panel at a side edge fold line and carrying opposite said side edge fold line said top cover;

a pair of inner end flaps joined to said top panel at either end edge thereof, each said inner end flap comprising a first inner reinforcing member, an inner flap member having a length, and a second inner reinforcing member all joined sequentially to each other from one of said end edges of the top panel, and the first and second reinforcing members being adapted to extend parallel to the top panel, and the inner flap member to extend transversely thereto and inwardly of the top panel end edge;

a pair of outer end flaps joined to said bottom panel at either end thereof, each said outer end flap comprising:

a first outer reinforcing member, an outer flap member, and a second outer reinforcing member all joined sequentially to each other from one of said end edges of the bottom panel, and the first and second outer reinforcing members extending parallel to the bottom panel and overlying the respective inner reinforcing members; and a pair of end covers joined to said top cover at either end thereof, each said end cover comprising:

an end cover flap joined to the top cover and having a length not exceeding substantially the length of the inner flap member, a cover bracing member affixed to the cover flap outwardly thereof, and the bracing member being received between the side walls of the carton and abutting the outer flap member;

whereby the carton has quadruple-thickness, reinforced top and bottom panel end edges and is adapted to be sealed by two short pieces of tape applied in an L-form between the end covers and the bottom panel.

5. A mailing carton as defined in claim 4, wherein the first inner reinforcing member is folded to lie against an end edge of the top panel with the inner end flap member extending transversely thereto and the second inner reinforcing member folded to lie upon an end edge of the bottom panel; and wherein the first outer reinforcing member overlies the second inner reinforcing member, the outer end flap overlies the inner end flap member, and the second outer reinforcing member overlies the first inner reinforcing member, and the end cover bracing member overlies the first outer reinforcing member, whereby to brace the ends of the carton with three vertical layers of sheet stock and with four horizontal layers of sheet stock at each of the top and bottom panels thereof.

6. A blank of corrugated, sheet-form material cut and scored for forming a mailing carton, the blank comprising:

five primary rectangular panels comprising top, bottom, cover, and two side panels joined edgewise one to another on first parallel fold lines and the top, bottom and cover panels having end edges transverse to said fold lines;

six end flap panels each joined to one of the top, bottom, and cover panels along second fold lines at said end edges of said top, bottom, and cover panels, each said end flap panel joined to the top and bottom panels comprising a first reinforcing member, an end flap, and a second reinforcing member in order outwardly from the end edges of the top and bottom panels, the end flaps having lengths transverse to the end edges, the reinforcing members being foldable into positions adjacent and parallel to said top and bottom panels adjacent the end edges thereof, each said end flap panel joined to the cover panel comprising an end cover having a length transverse to the end edges not exceeding substantially the length of a larger one of the end flaps and an end cover bracing member in order outwardly from the end edge of the cover panel, the end cover being foldable into a position in spaced parallel adjacency to the end flaps and the bracing member being foldable into parallel adjacency to one of the reinforcing members and into abutting relationship to one of said end flaps, whereby to provide a quadruple-thickness of sheet materials on each end edge of the carton and a triple-thickness air cell structure on each end wall when assembled, to resist shocks upon and damage to carton contents.

* * * * *